US011970255B2

(12) United States Patent
Zhou

(10) Patent No.: US 11,970,255 B2
(45) Date of Patent: Apr. 30, 2024

(54) MULTI-FUNCTIONAL BABY FLOAT

(71) Applicant: Zhejiang Mambobaby Baby Products Co., Ltd., Yiwu (CN)

(72) Inventor: Weixin Zhou, Jinhua (CN)

(73) Assignee: Zhejiang Mambobaby Baby Products Co., Ltd., Yiwu (CN)

( * ) Notice: Subject to any disclaimer, the term of this patent is extended or adjusted under 35 U.S.C. 154(b) by 230 days.

(21) Appl. No.: 17/644,797

(22) Filed: Dec. 17, 2021

(65) Prior Publication Data

US 2022/0111942 A1 Apr. 14, 2022

(30) Foreign Application Priority Data

Nov. 30, 2021 (CN) ..... 202122969415.8

(51) Int. Cl.
*B63C 9/125* (2006.01)
*B63B 34/565* (2020.01)

(52) U.S. Cl.
CPC ..... *B63C 9/1255* (2013.01); *B63B 34/565* (2020.02)

(58) Field of Classification Search
CPC ..... B63C 9/1255; B63B 34/50; B63B 34/52; B63B 34/54; B63B 34/56; B63B 34/565; A47C 15/006
See application file for complete search history.

(56) References Cited

U.S. PATENT DOCUMENTS 7,607,185 B1 * 10/2009 Minson ..... A47C 27/081 5/655
2006/0025029 A1 * 2/2006 Berenson ..... B63C 9/08 441/129
2011/0014832 A1 1/2011 Marciano
2019/0246801 A1 8/2019 Sloop
2020/0331569 A1 * 10/2020 Zhou ..... B63B 34/50

* cited by examiner

*Primary Examiner* — Andrew Polay
(74) *Attorney, Agent, or Firm* — Georgi Korobanov

(57) ABSTRACT

The present invention relates to a baby float. The multi-functional baby float comprises a float body and a buoyant tail for increasing the buoyancy of the back; the buoyant tail is detachably connected with the end of the float body; and the back of a head of the float body is provided with an elevating mechanism for raising the head of the float body. The elevating mechanism comprises an inflatable airbag or a connecting structure. The connecting structure comprises some rows of female buckles; the buoyant tail is provided with son buckles; and the buoyant tail is fixedly connected with the float body through the matching of the son buckles and the female buckles. The present invention has the characteristics that the back buoyancy can be increased to prevent roll-back, the buoyant tail can be detached and installed below a headrest.

6 Claims, 3 Drawing Sheets

MULTI-FUNCTIONAL BABY FLOAT

TECHNICAL FIELD

The present invention belongs to the technical field of safety protection for infants, and in particular relates to a multi-functional baby float.

BACKGROUND

The structures of the existing baby floats on the market are too simple. The float body does not have the anti-flip function. After the float flips, the legs of the baby are stuck and thus the baby is under a great risk of life. Therefore, the safety performance of the baby float is very important. In addition, although some baby floats have certain safety performance, the function is too single. When the baby needs rest or feeding in the swimming process, it is very inconvenient to carry the baby in a baby stroller or rocking chair.

Therefore, it is very important to design a multi-functional baby float which can prevent roll-back and can also provide a comfortable rest environment for babies.

For example, the Chinese patent document with application No. CN201710433106.4 describes a safe baby float, which comprises a float body and an anti-flip component. The float body comprises an annular air chamber and an alarm device. A plurality of airbags are fixedly glued on the inner bottom surface of the annular air chamber. The alarm device is arranged on the upper surface of the annular air chamber. The anti-flip component comprises a connecting rope and a sinking ball. One end of the connecting rope is connected with the lower surface of the annular air chamber, and the other end is connected with the sinking ball. The safety performance of the baby float is greatly improved by adding the anti-flip component and adding a plurality of airbags inside the float body; and the alarm device is installed on the upper air chamber. When the upper air chamber flips, the alarm function is realized to prevent the baby from drowning and bringing the life risk to the baby. However, the disadvantage is that the product function is single. A comfortable environment for resting or feeding cannot be provided for the baby except for swimming assistance.

SUMMARY

In order to overcome the problems of poor safety and single function of the existing baby float in the prior art, the present invention provides a multi-functional baby float which can prevent roll-back and can also provide a comfortable rest environment for babies.

To achieve the above purpose, the present invention adopts the following technical solution:

The multi-functional baby float comprises a float body and a buoyant tail for increasing the buoyancy of the back; the buoyant tail is detachably connected with the end of the float body; and the back of a head of the float body is provided with an elevating mechanism for raising the head of the float body.

Preferably, the elevating mechanism comprises an inflatable airbag; and the inflatable airbag is provided with an air nozzle for inflating and deflating.

Preferably, the elevating mechanism comprises a connecting structure matched with the buoyant tail.

Preferably, the connecting structure comprises a plurality of rows of female buckles; the buoyant tail is provided with at least two son buckles; and the buoyant tail is fixedly connected with the float body through the matching of the son buckles and the female buckles.

Preferably, the connecting structure comprises two hooks & loops; the two hooks & loops are respectively fixed to the back of the float body and the surface of the buoyant tail; and the buoyant tail is fixedly connected with the float body through the matching of the two hooks & loops.

Preferably, the connecting structure comprises a strap for binding an elevated object; the strap is fixed to the back of the float body; and the elevated object comprises the buoyant tail.

Preferably, the float body is provided with a headrest; and the headrest and the float body are detachably connected.

Preferably, the float body is also provided with a five-point seat belt.

Preferably, the float body is provided with a detachable sunshade.

Preferably, the float body is also provided with a chest support, a back support and a shoulder strap.

Compared with the prior art, the present invention has the following beneficial effects: (1) the present invention can increase the buoyancy of the back and prevent the roll-back when the baby swims; (2) the buoyant tail in the present invention can be detached and installed below the headrest to raise the headrest, so that the baby can rest more comfortably in the float, and feeding on land is also convenient.

Figure 1:
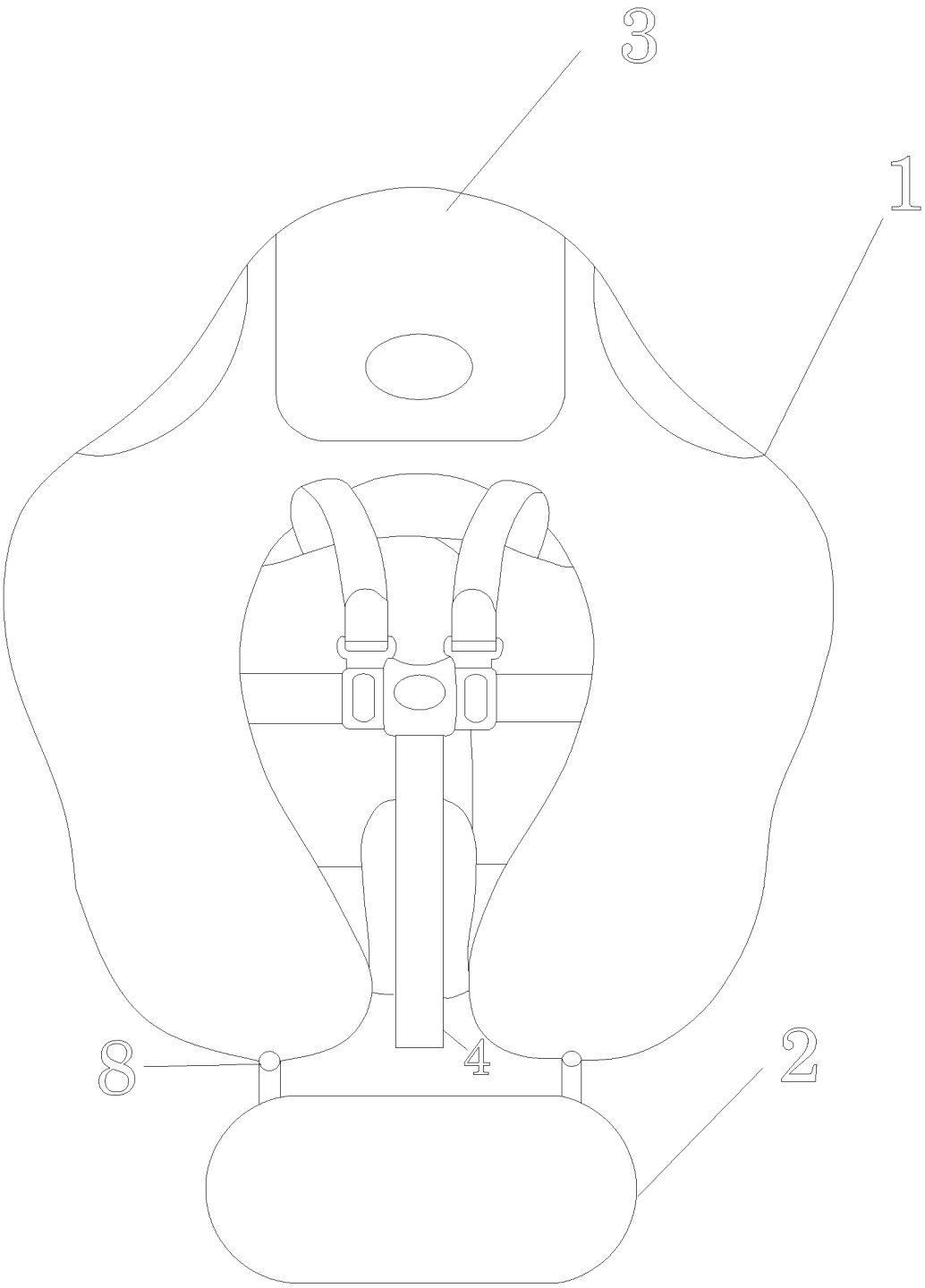
FIG. 1 is a structural schematic diagram of a multi-functional baby float in embodiment 1 of the present invention.

In the figures: float body 1; buoyant tail 2; headrest 3; five-point seat belt 4; hook & loop 5; strap 6; inserting hole 7; snap fastener 8; inflatable airbag 9; and air nozzle 10.

DETAILED DESCRIPTION

To more clearly describe embodiments of the present invention, specific embodiments of the present invention will be described below in combination with drawings. Apparently, the drawings in the following description are merely some embodiments of the present invention, and for those ordinary skilled in the art, other drawings can also be obtained according to these drawings without contributing creative labor, and other embodiments can be obtained.

Embodiment 1

Figure 2:
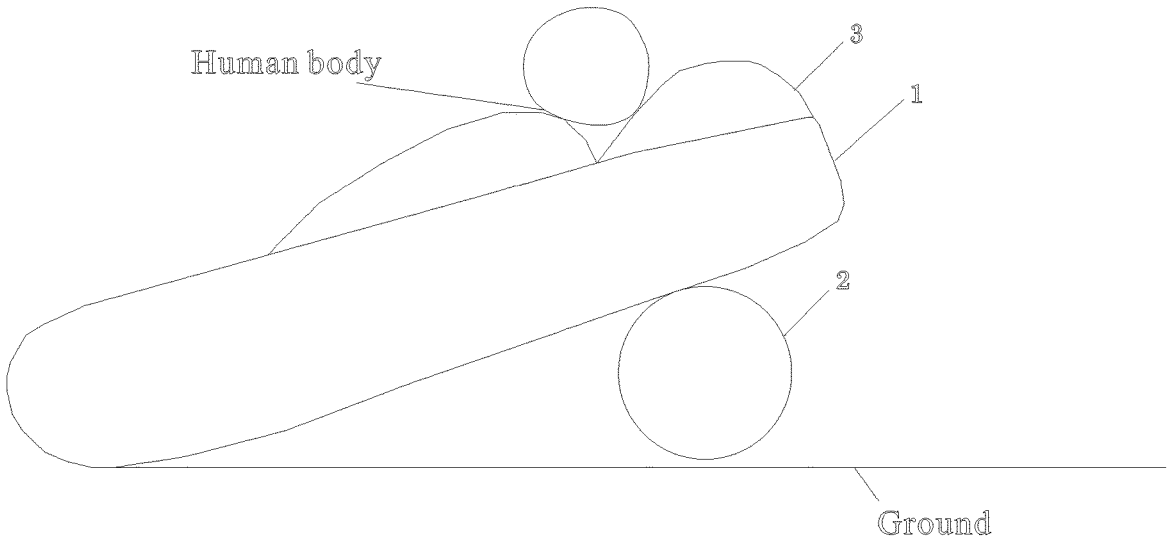
FIG. 2 is a side view of a multi-functional baby float when a buoyant tail is disassembled and installed below a headrest in embodiment 1 of the present invention.

As shown in FIG. 1 and FIG. 2, a multi-functional baby float comprises a float body 1 and a buoyant tail 2 for increasing the buoyancy of the back; the buoyant tail is detachably connected with the end of the float body; and the back of a head of the float body is provided with an elevating mechanism for raising the head of the float body. The elevating mechanism comprises a connecting structure matched with the buoyant tail. The float body is also provided with a headrest 3; and the connecting structure is located on the back of the headrest.

The buoyant tail can increase the buoyancy of the back and prevent the roll-back when the baby swims. The buoyant tail is specifically detachably connected with the float through snap fasteners 8.

Further, the connecting structure comprises a plurality of rows of female buckles; the buoyant tail is provided with two son buckles; and the buoyant tail is fixedly connected with the float body through the matching of the son buckles and the female buckles. According to actual needs, the user can connect the son buckles on the buoyant tail with any row of female buckles to elevate the headrest at different angles.

Further, the float body is also provided with a five-point seat belt 4. The five-point seat belt is used to strengthen the fixation for the baby.

Further, the float body is in U shape.

Embodiment 2

Figure 3:
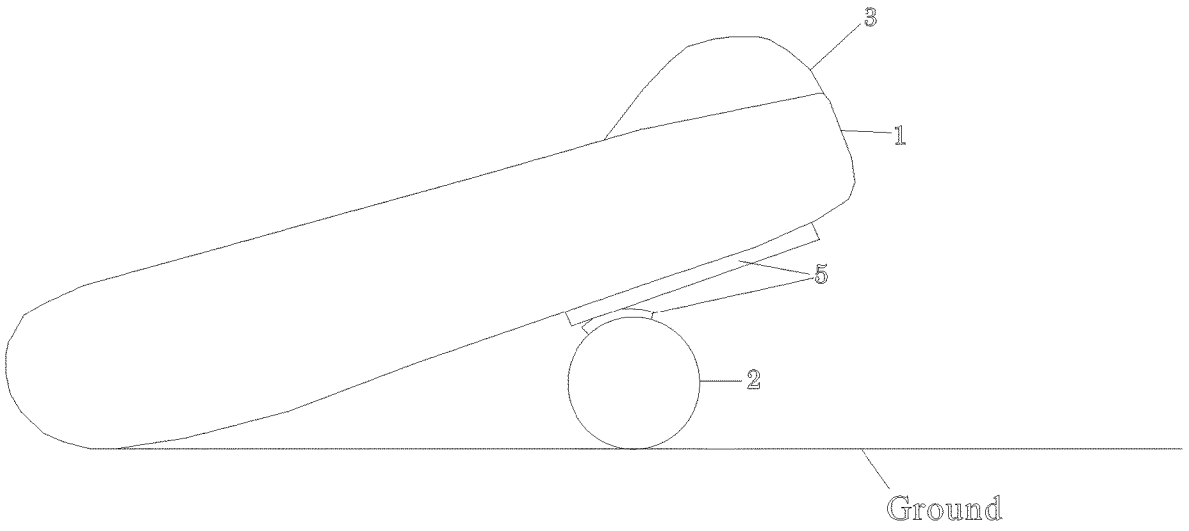
FIG. 3 is a side view of a multi-functional baby float when a buoyant tail is disassembled and installed below a headrest in embodiment 2 of the present invention.

The difference from embodiment 1 is that, as shown in FIG. 3, the connecting structure comprises two hooks & loops 5; the two hooks & loops are respectively fixed to the back of the float body and the surface of the buoyant tail; and the buoyant tail is fixedly connected with the float body through the matching of the two hooks & loops.

Due to the connection mode of the hooks & loops, the user can connect the hook & loop on the buoyant tail with any position of the hook & loop on the back of the float body to elevate the headrest at different angles according to actual needs. For the convenience of angle adjustment, the buoyant tail is designed to be cylindrical, and can be elevated at different angles by rolling back and forth for convenient adjustment.

Embodiment 3

Figure 4:
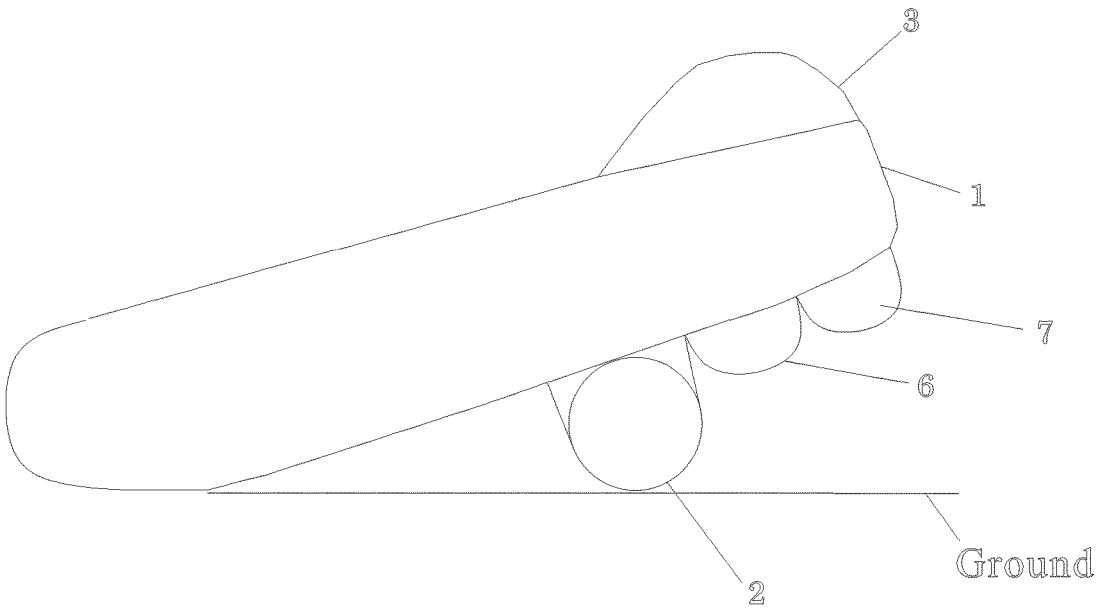
FIG. 4 is a side view of a multi-functional baby float when a buoyant tail is disassembled and installed below a headrest in embodiment 3 of the present invention.

The difference from embodiment 1 and embodiment 2 is that, as shown in FIG. 4, the connecting structure comprises a strap 6 for binding an elevated object; the strap is fixed to the back of the float body; and the elevated object comprises the buoyant tail.

The strap is closed with the back of the float body through the hooks & loops or inserting buckles to ensure that the elevated object is bound.

In addition, as shown in FIG. 4, the strap can be fixed in a wavy shape, so that three inserting holes 7 for placing the elevated object (the buoyant tail) are arranged between the strap and the back of the float body. The positions of the inserting holes are different. The user elevates the headrest at different angles by placing the elevated object (the buoyant tail) in the inserting holes at different positions.

Embodiment 4

Figure 5:
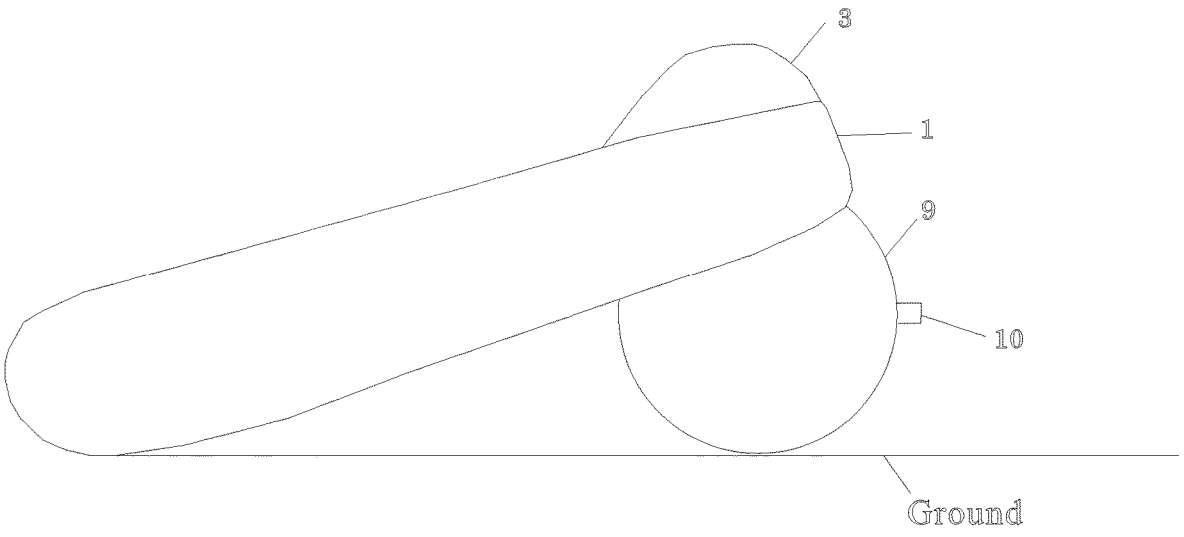
FIG. 5 is a side view of a multi-functional baby float when an inflatable airbag contains gas in embodiment 4 of the present invention.

The difference from embodiment 1, embodiment 2 and embodiment 3 is that, as shown in FIG. 5, the elevating mechanism comprises an inflatable airbag 9. The inflatable airbag is provided with an air nozzle 10 for inflating and deflating. When the head of the float body needs to be elevated, the airbag can be inflated through the air nozzle.

In addition, the elevating mechanism can also be an accommodating bag, and the disassembled buoyant tail can be placed in the accommodating bag or other block-shaped objects to elevate the head of the float body.

In addition, the float body can also be provided with a detachable sunshade for providing a shading service for the baby. The float body can also be provided with a chest support, a back support and a shoulder strap for strengthening the fixation for the baby in the float. In addition, the headrest is detachably connected with the float body for the convenience of replacement and washing of the headrest.

The present invention can increase the buoyancy of the back and prevent the roll-back when the baby swims. The buoyant tail in the present invention can be detached and installed below the headrest to raise the headrest, so that the baby can rest more comfortably in the float, and feeding on land is also convenient.

The above only describes the preferred embodiments and principle of the present invention in detail. For those ordinary skilled in the art, changes may be made to specific embodiments in accordance with the thought provided by the present invention, and these changes shall also be considered as the protection scope of the present invention.

The invention claimed is:

1. A multi-functional baby float, comprising a float body and a buoyant tail for increasing the buoyancy of the back; the buoyant tail is detachably connected with the end of the float body; and the back of a head of the float body is provided with an elevating mechanism for raising the head of the float body;

wherein the elevating mechanism comprises a connecting c u matched with the buoyant tail, wherein the connecting structure comprises a stray for binding an elevated object: the strap is fixed to the back of the float body; and the elevated object comprises the buoyant tail.

2. The multi-functional baby float according to claim 1, wherein the elevating mechanism comprises an inflatable airbag; and the inflatable airbag is provided with an air nozzle for inflating and deflating.

3. The multi-functional baby float according to claim 1, wherein the connecting structure comprises a plurality of rows of female buckles; the buoyant tail is provided with at least two son buckles; and the buoyant tail is fixedly connected with the float body through the matching of the son buckles and the female buckles.

4. The multi-functional baby float according to claim 1, wherein the connecting structure comprises two hooks & loops; the two hooks & loops are respectively fixed to the back of the float body and the surface of the buoyant tail; and the buoyant tail is fixedly connected with the float body through the matching of the two hooks & loops.

5. The multi-functional baby float according to claim 1, wherein the float body is provided with a headrest; and the headrest and the float body are detachably connected.

6. The multi-functional baby float according to claim 1, wherein the float body is also provided with a five point seat belt.

* * * * *